US012593907B2

(12) United States Patent
Kim et al.

(10) Patent No.: US 12,593,907 B2
(45) Date of Patent: Apr. 7, 2026

(54) STICK-TYPE PRODUCT WITH HEATING FUNCTION

(71) Applicant: AMOREPACIFIC CORPORATION, Seoul (KR)

(72) Inventors: Serin Kim, Yongin-si (KR); Jeongin Lee, Yongin-si (KR)

(73) Assignee: AMOREPACIFIC CORPORATION, Seoul (KR)

( * ) Notice: Subject to any disclaimer, the term of this patent is extended or adjusted under 35 U.S.C. 154(b) by 303 days.

(21) Appl. No.: 18/366,304

(22) Filed: Aug. 7, 2023

(65) Prior Publication Data

US 2024/0065417 A1 Feb. 29, 2024

(30) Foreign Application Priority Data

Aug. 25, 2022 (KR) ..... 10-2022-0106673

(51) Int. Cl.
*A45D 40/26* (2006.01)
*A45D 34/04* (2006.01)

(52) U.S. Cl.
CPC ..... *A45D 40/265* (2013.01); *A45D 34/045* (2013.01); *A45D 2200/157* (2013.01)

(58) Field of Classification Search
CPC ..... A45D 40/265; A45D 2200/157; A45D 34/045; A45D 40/262; A45D 34/042
USPC ..... 401/1, 126, 127, 129
See application file for complete search history.

(56) References Cited

U.S. PATENT DOCUMENTS 7,469,702 B2 * 12/2008 Kim ..... A46B 3/18 132/218
7,980,776 B2 * 7/2011 Cho ..... A45D 40/265 401/1
11,653,739 B1 * 5/2023 Zheng ..... A45D 34/00 401/126

FOREIGN PATENT DOCUMENTS

CN 101437419 A 5/2009
KR 20-2009-0012373 U 2/2009

* cited by examiner

*Primary Examiner* — David J Walczak
(74) *Attorney, Agent, or Firm* — Sughrue Mion, PLLC

(57) ABSTRACT

A stick-type product having a heating function. The stick-type product includes a handle part that is graspable by a user; a brush rod extending from the handle part; and an application part provided at one end of the brush rod and configured to apply a cosmetic article. The application part has portions of different temperatures by being provided with materials which are capable of heat generation and which have different thermal conductivities.

15 Claims, 8 Drawing Sheets

【FIG. 1】
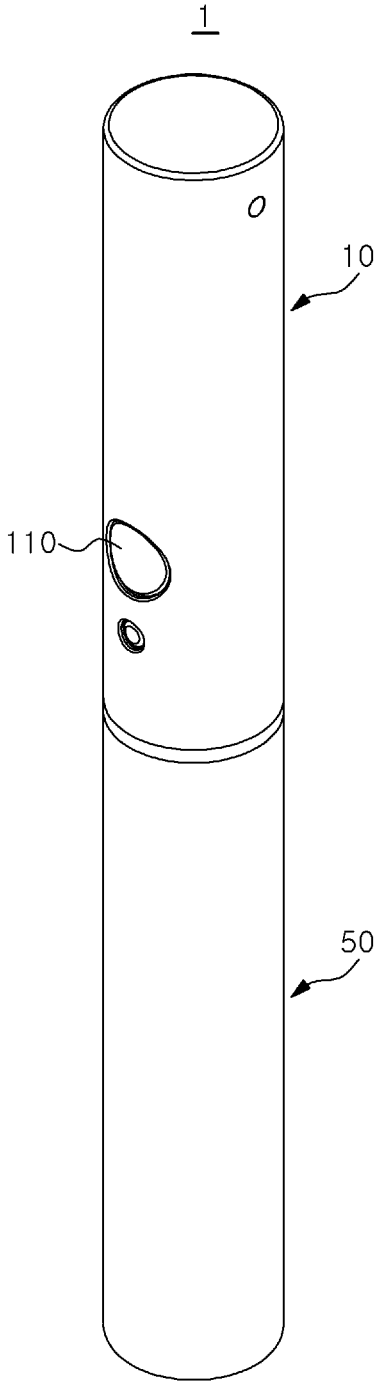

【FIG. 2】
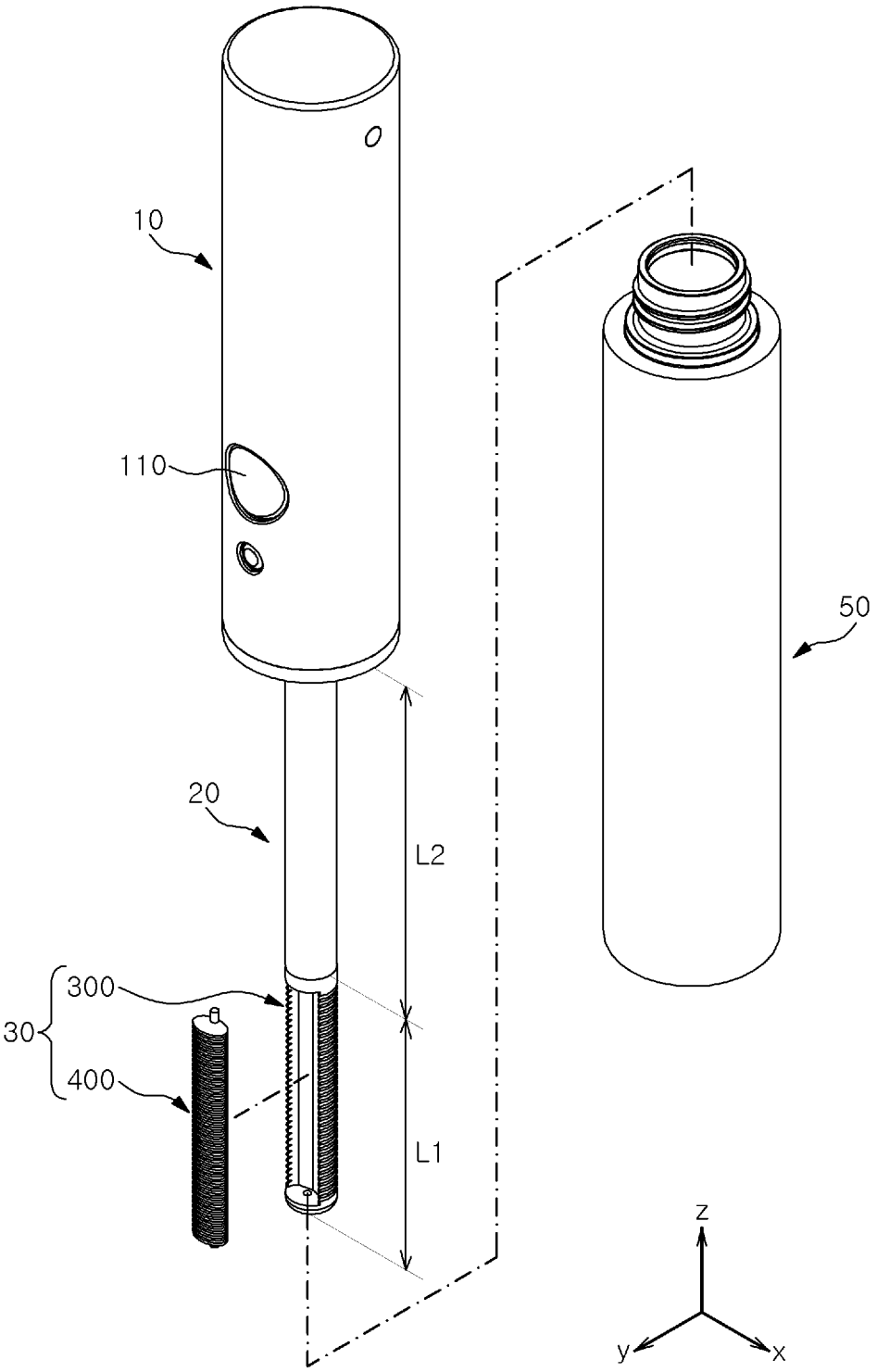

【FIG. 3】
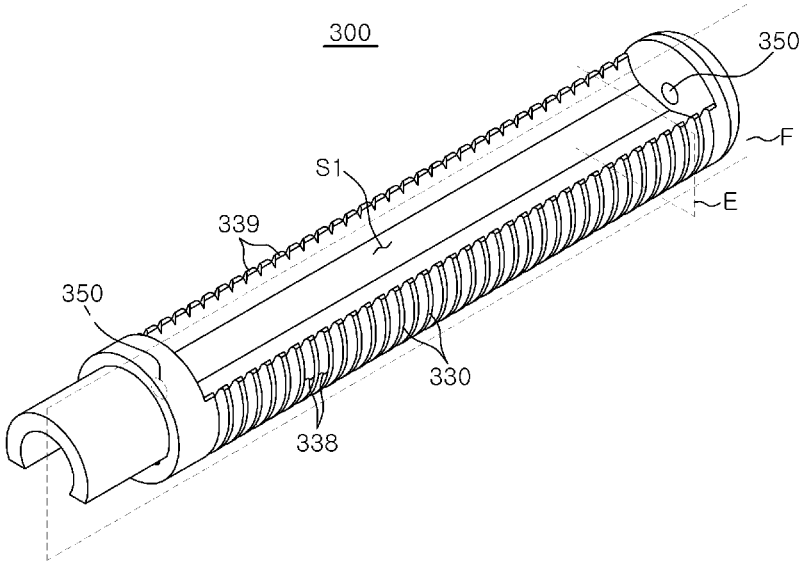

【FIG. 4】
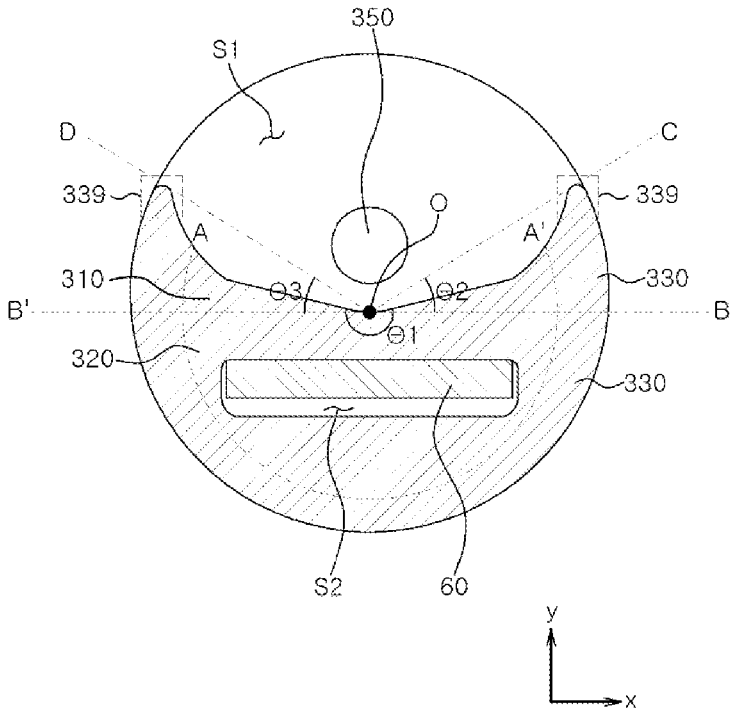
【FIG. 5】
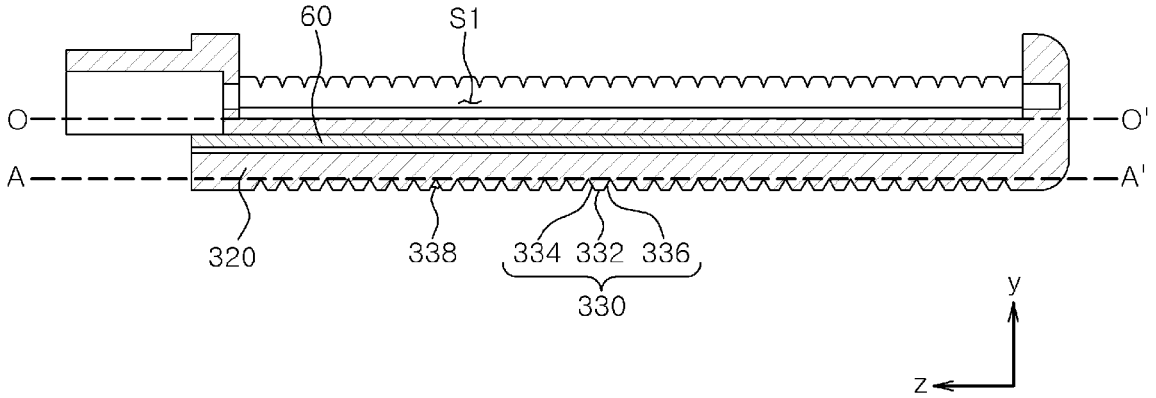

【FIG. 6】
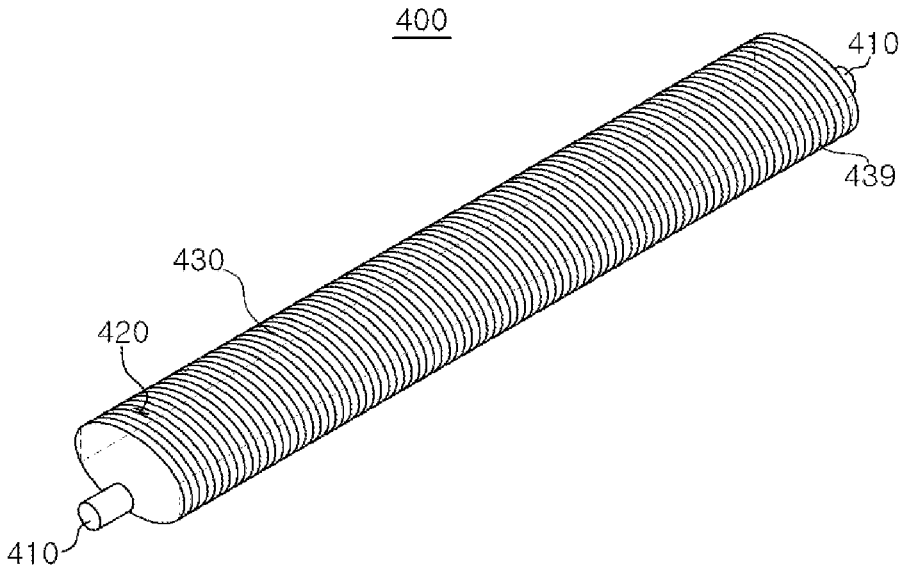

【FIG. 7】
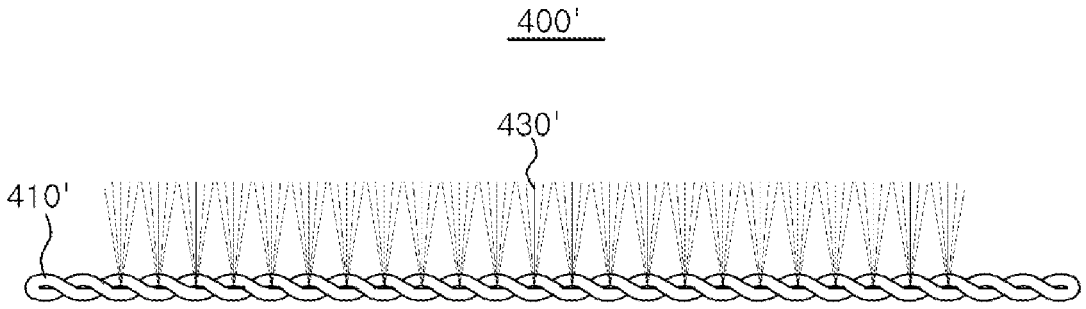
【FIG. 8】
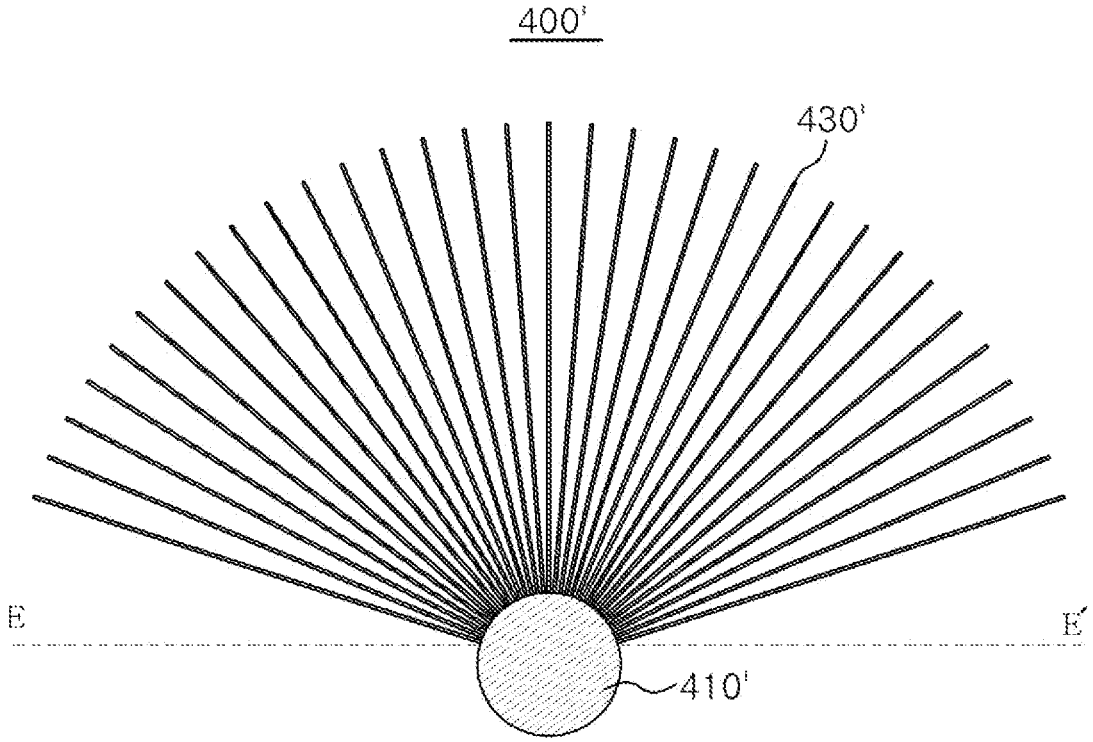

【FIG. 9】
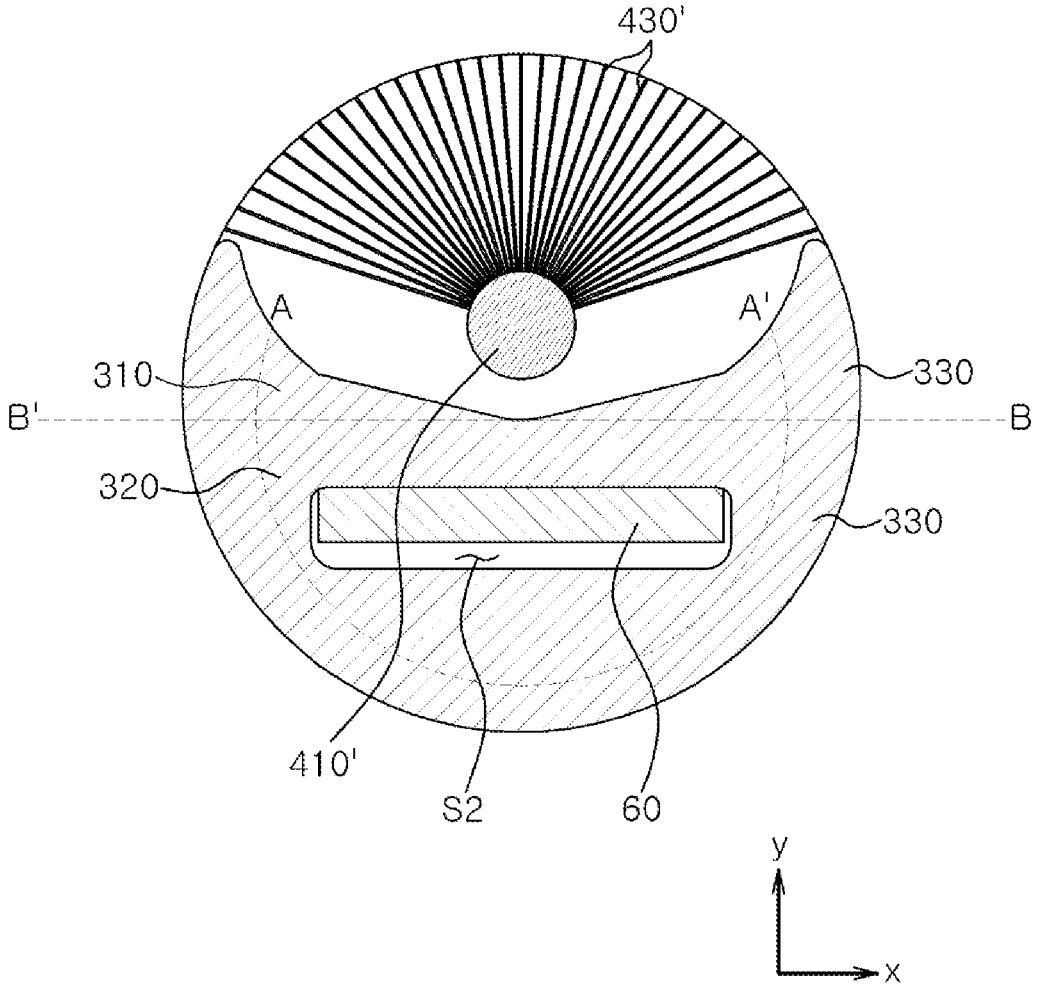

【FIG. 10】
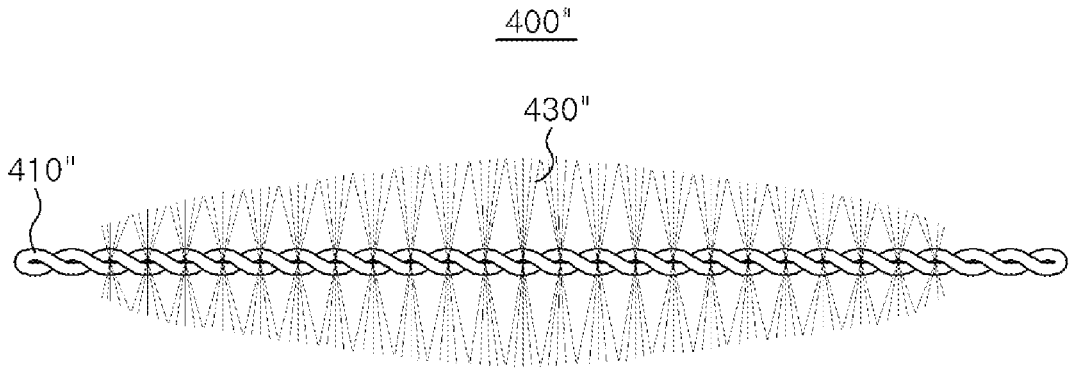
【FIG. 11】
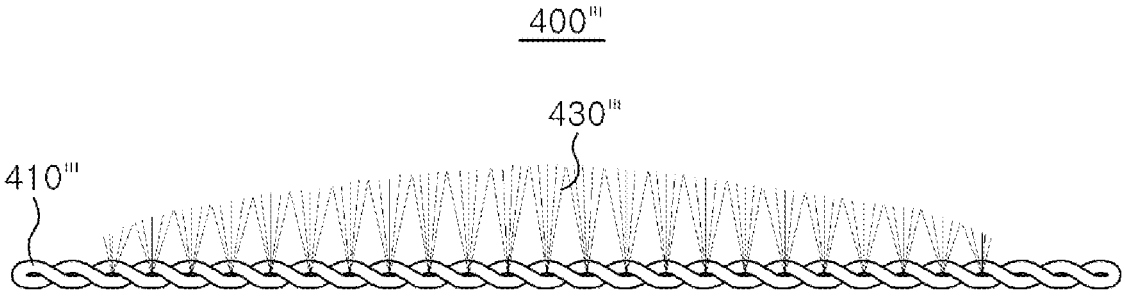

STICK-TYPE PRODUCT WITH HEATING FUNCTION

CROSS-REFERENCE TO RELATED APPLICATION(S)

This application is based on and claims priority of Korean Patent Application No. 10-2022-0106673, filed on Aug. 25, 2022 with the Korean Intellectual Property Office, the entire content of which is hereby incorporated by reference.

TECHNICAL FIELD

The present disclosure relates to a stick-type product having a heating function.

BACKGROUND

Mascara is a type of cosmetic product used by women to make up their eyelashes.

In general, Asians have shorter eyelashes and a looser curl angle than Westerners, so it takes a lot of time and effort to curl their eyelashes.

For example, in order to curl eyelashes, a user may use an eyelash curler to curl them up, do an eyelash perm, or use a heated tool to curl them up.

However, the eyelash curler applies physical force to the eyelashes by squeezing them, which can cause problems such as pulling and injuring the eyelashes by squeezing the eyeball instead of the eyelashes.

In addition, eyelash perms are a method of applying chemical modification to eyelashes, which can result in chemical-induced eyelash fallout and eyelash kinking.

Furthermore, heated tools can be formed by applying heat to a specific object (e.g., a wooden skewer), and these heated tools are not optimized for eyelash curling, making it difficult to achieve the optimal temperature for curling eyelashes, as well as risking burns during the heating process.

DOCUMENT OF RELATED ART

Patent Document

Patent document: Korean Utility Registration Application Publication No. 20-2009-0012373 U (2009 Dec. 3)

SUMMARY

An embodiments of the present disclosure, which has been conceived to address the problems described above, is to provide a stick-type product having a heating function that is capable of facilitating the curling of eyelashes.

Further, an embodiment of the present disclosure is to provide a stick-type product having a heating function that is capable of simultaneously performing eyelash makeup by applying a cosmetic article and curling by heating.

Further, an embodiment of the present disclosure is to provide a stick-type product having a heating function that is capable of providing an optimal temperature for curling eyelashes without causing burning even when in contact with the user.

According to an aspect of the present invention, there is provided a stick-type product having a heating function comprising: a handle part that is graspable by a user; a brush rod extending from the handle part; and an application part provided at one end of the brush rod and configured to apply a cosmetic article, wherein the application part has portions of different temperatures by being provided with materials which are capable of heat generation and which have different thermal conductivities.

Further, there is provided a stick-type product having a heating function, wherein the application part includes: a heat-generating applicator part having a plurality of metal brushes formed along an outer circumference thereof; and a brush part including non-metal brushes detachable from the heat-generating applicator part and formed of a material having a lower thermal conductivity than the metal brushes.

Further, there is provided a stick-type product having a heating function, wherein the metal brushes are formed of metal; and the non-metal brushes are formed of nylon having a lower thermal conductivity than the metal.

Further, there is provided a stick-type product having a heating function, wherein each of the metal brushes includes: a flat surface parallel to the direction in which the heat-generating applicator part extends; a first inclined surface extending from one side of the flat surface and inclined in one direction relative to the direction in which the heat-generating applicator part extends; and a second surface extending from the other side of the flat surface and inclined in the other direction relative to the direction in which the heat-generating applicator part extends.

Further, there is provided a stick-type product having a heating function, wherein a metal brush groove is formed between the plurality of metal brushes, which is a space in which the cosmetic article is collected.

Further, there is provided a stick-type product having a heating function, wherein a heat-generating element capable of heating to a predetermined temperature is provided within the heat-generating applicator part.

Further, there is provided a stick-type product having a heating function, wherein the heat-generating applicator part includes; a first heat-generating applicator having a first space formed therein capable of accommodating the brush part; and a second heat-generating applicator integrally formed with the first heat-generating applicator and having a second space in which a heat-generating element capable of being heated to a predetermined temperature is inserted, and wherein the metal brushes are formed along an outer circumference of the first heat-generating applicator and the second heat-generating applicator.

Further, there is provided a stick-type product having a heating function, wherein based on a cross-section of the application part cut along a first direction, the metal brushes formed on the first heat-generating applicator and the metal brushes formed on the second heat-generating applicator are located opposite to each other based on a first imaginary straight line B-B'.

Further, there is provided a stick-type product having a heating function, wherein based on a cross-section of the application part cut along a first direction, the first space in which the brush part is disposed is provided as a concave groove formed on the heat-generating applicator part.

Further, there is provided a stick-type product having a heating function, wherein based on a cross-section of the application part cut along a first direction, the metal brushes formed on the second heat-generating applicator are distributed to have a first angle based on a first imaginary straight line B-B', the metal brushes disposed on one side and formed on the first heat-generating applicator are distributed to have a second angle based on the first imaginary straight line B-B', and the metal brushes disposed on the other side and formed on the first heat-generating applicator are distributed to have a third angle based on the first imaginary straight line B-B', and wherein the first angle is 180 degrees, and the second angle and the third angle are each between 1 degree and 60 degrees.

Further, there is provided a stick-type product having a heating function, wherein the end portions of the metal brushes and at least portions of the non-metal brushes are in contact with each other.

Further, there is provided a stick-type product having a heating function, wherein the metal brushes are formed of a metal that is not deformed by an external force less than or equal to a certain magnitude applied by a user; and the non-metal brushes are formed of a material that is deformed by the external force.

Further, there is provided a stick-type product having a heating function, further comprising: a container configured to store the cosmetic article and accommodate the brush rod and the application part.

Further, there is provided a stick-type product having a heating function, wherein the metal brushes represent a temperature from 45° C. to 65° C. during operation of the stick-type product having a heating function.

Further, there is provided a stick-type product having a heating function, wherein based on a cross-section of the application part cut along a first direction, the metal brushes separated by a first distance from a center of the application part represent a specific temperature; and the non-metal brushes separated by the first distance from the center represent a temperature lower than the specific temperature.

Further, there is provided a stick-type product having a heating function of claim 2, wherein the brush part includes: a first connecting member coupled to the heat-generating applicator part; and a plurality of non-metal brushes coupled in a different direction relative to the direction in which the first connecting member extends, and wherein based on a cross-section of the application part cut along a first direction, the non-metal brushes are disposed only on one side relative to a fourth imaginary straight line passing through the first connecting member.

According to an embodiment of the present disclosure, the stick-type product having a heating function has the advantage of facilitating eyelash curling.

In addition, according to an embodiment of the present disclosure, the stick-type product having a heating function has the effect of simultaneously performing eyelash makeup by applying a cosmetic article and curling by heating.

In addition, according to an embodiment of the present disclosure, the stick-type product having a heating function has the advantage of providing an optimal temperature for curling eyelashes without causing burning even when in contact with the user.

BRIEF DESCRIPTION OF DRAWINGS

The above and other objects, features and advantages of this disclosure will become more apparent to those skilled in the art by describing exemplary embodiments thereof in detail with reference to the accompanying drawings, in which:

FIG. 1 is a perspective view of a stick-type product having a heating function according to one embodiment of the present disclosure;

FIG. 2 is an exploded perspective view of the stick-type product having a heating function of FIG. 1;

FIG. 3 is an enlarged view of the heat-generating applicator part in the stick-type product having a heating function of FIG. 2;

FIG. 4 is a cross-sectional view of the heat-generating applicator part of FIG. 3 cut along a first direction;

FIG. 5 is a cross-sectional view of the heat-generating applicator part of FIG. 3 cut along a second direction;

FIG. 6 is a view schematically illustrating one embodiment of a brush part in the stick-type product having a heating function of FIG. 2;

FIG. 7 is a view schematically illustrating a brush part according to another embodiment of the present disclosure;

FIG. 8 is a view schematically illustrating a cross-section of the brush part of FIG. 7 cut along a first direction;

FIG. 9 is a view schematically illustrating a cross-section of an application part in which the brush part and the heat-generating applicator part of FIG. 7 are combined, cut along a first direction.

FIG. 10 is a view schematically illustrating a brush part according to further another embodiment of the present disclosure; and FIG. 11 is a view schematically illustrating a brush part according to yet another embodiment of the present disclosure.

DETAILED DESCRIPTION OF EXEMPLARY EMBODIMENTS

Hereinafter, specific embodiments of the present disclosure will be described in detail with reference to the accompanying drawings. Additionally, it is noted that in describing the present disclosure, the detailed description of known related configurations or functions may be omitted if it is deemed that such description may obscure essential points of the present disclosure.

FIG. 1 is a perspective view of a stick-type product 1 having a heating function according to one embodiment of the present disclosure; FIG. 2 is an exploded perspective view of the stick-type product 1 having a heating function of FIG. 1; FIG. 3 is an enlarged view of the heat-generating applicator part 300 in the stick-type product 1 having a heating function of FIG. 2; FIG. 4 is a cross-sectional view of the heat-generating applicator part 300 of FIG. 3 cut along the first direction; FIG. 5 is a cross-sectional view of the heat-generating applicator part 300 of FIG. 3 cut along a second direction; and FIG. 6 is a view schematically illustrating one embodiment of a brush part 400 in the stick-type product 1 having a heating function of FIG. 2.

Referring to FIGS. 1 to 6, a stick-type product 1 having a heating function according to one embodiment of the present disclosure may include a handle part 10 that can be grasped by a user; a brush rod 20 extending from the handle part 10; and an application part 30 provided at one end of the brush rod 20 for applying a cosmetic article.

Here, the application part 30 may have portions of different temperatures by being provided with materials which are capable of heat generation and which have different thermal conductivities.

Specifically, the application part 30 may include a heat-generating applicator part 300 including metal brushes 330 formed of a metal capable of heating to a specific temperature; and a brush portion 400 including non-metal brushes 430 formed of a material having a lower thermal conductivity than the metal brushes 330.

In this embodiment, a stick-type product is a product having a brush rod that extends in one direction and may include a mascara for eyelash makeup, a lip tint or lip gloss for lip makeup, a concealer for covering blemishes, and the like. In this embodiment, the stick-type product is described as an example of a mascara.

Further, the stick-type product 1 having a heating function may include a container 50 for storing the cosmetic article and accommodating the brush rod 20 and the application part 30. The cosmetic article stored in the container 50 may be provided with a stable composition for heating, and a detailed description thereof will be described in more detail later.

In this embodiment, the imaginary surface "E" shown in FIG. 3 may be understood as cutting the heat-generating applicator part 300 in a first direction, and the virtual surface "F" shown in FIG. 3 may be understood as cutting the heat-generating applicator part 300 in a second direction.

The handle part 10 may have a predetermined shape to allow a user to grasp it.

In this embodiment, the handle part 10 and the container 50 are described as having the shape of a column as an example. However, the shape of the handle part 10 and the container 50 is not limited herein.

The interior of the handle part 10 may include a battery (not shown), which is the power source for the heat-generating element 60 described later.

A button 110 for operating the heat-generating element 60 may be disposed on one side of the handle part 10.

In addition, a charging terminal for charging a battery (not shown) may be provided on the other side of the handle part 10.

The brush rod 20 may extend in one direction from the handle part 10.

Inside the brush rod 20, wires may be disposed to electrically connect the battery (not shown) and the heat-generating element 60.

A thread (not shown), which may engage with the neck of the container 50, may be formed in the lower interior of the handle part 10 surrounding the brush rod 20.

The application part 30 for applying the cosmetic article may be provided at one end of the brush rod 20.

The ratio of the length L1 of the application part 30 to the length L2 of the brush rod 20 may be provided as 1:1 to 2.

For example, the length L1 of the application part 30 may be formed to be 25 mm, and the length L2 of the brush rod 20 may be formed to be 40 mm.

Additionally, the ratio of the diameter of the application part 30 to the diameter of the brush rod 20 may be provided as 1:0.5 to 1, preferably 6:5.

The application part 30 may include a heat-generating applicator part 300, which includes the metal brushes 330 formed of metal; and a brush part 400, which includes the non-metal brushes 430 formed of a material having a lower thermal conductivity than metal.

The heat-generating applicator part 300 may contain the heat-generating element 60 therein, and may receive heat from the heat-generating element 60 and dissipate the heat to the outside.

That is, during the operation of the stick-type product 1 having a heating function, the heat-generating element 60 may heat the metal brushes 330 to a specific temperature.

During the operation of the stick-type product 1 having a heating function, the specific temperature represented by the metal brushes 330 is 45° C. to 65° C., preferably 50° C. to 60° C., and more preferably 55° C.

In this case, the non-metal brushes 430 may represent less than 45° C., and preferably less than 35° C.

The metal brushes 330, which are formed of metal, may be provided on the outer circumference of the heat-generating applicator part 300.

Each of the metal brushes 330 includes a flat surface 332 parallel to the direction in which the heat-generating applicator part 300 extends; a first inclined surface 334 extending from one side of the flat surface 332 and inclined in one direction relative to the direction in which the heat-generating applicator part 300 extends; and a second inclined surface 336 extending from the other side of the flat surface 332 and inclined in the other direction relative to the direction in which the heat-generating applicator part 300 extends (see FIG. 5).

The first inclined surface 334 and the second inclined surface 336 may be formed in oppositely inclined directions to each other.

It may be understood that the shape of the flat surface 332 and the first and second inclined surfaces 335 and 336 are represented based on a cross-section of the heat-generating applicator part 300 cut along the second direction.

In addition, a plurality of metal brush grooves 338, which are spaces where the cosmetic article may be collected, are formed between the plurality of metal brushes 330.

The plurality of metal brushes 330 may be formed in parallel to each other.

For example, there may be 10 to 100 metal brushes 330, and there may also be 10 to 100 metal brush grooves 338 formed by the metal brushes 330.

The cosmetic article may be collected in the metal brush grooves 338.

The user may touch the metal brushes 330 which represent a specific temperature (e.g., 45° C. to 65° C.) and which hold the cosmetic article, to the eyelashes. Thereby, the eyelashes may be curled into a curved shape and eyelash makeup may be performed.

In addition, the plurality of metal brushes 330 may also be formed into a threaded shape.

The heat-generating applicator part 300 includes a first heat-generating applicator 310 having a first space S1 formed therein capable of accommodating the brush part 400; and a second heat-generating applicator 320 integrally formed with the first heat-generating applicator 310 and having a second space S2 formed therein in which a heat-generating element 60 capable of being heated to a predetermined temperature is inserted (see FIG. 4).

Here, the metal brushes 330 are formed along the outer circumference of the first heat-generating applicator 310 and the second heat-generating applicator 320.

The first heat-generating applicator 310, the second heat-generating applicator 320, and the metal brushes 330 may be integrally formed.

The first heat-generating applicator 310, the second heat-generating applicator 320, and the metal brushes 330 may be made of the same material, metal.

The heat-generating applicator part 300 may be provided to represent a particular color that contrasts with the cosmetic article, or it may be provided to represent a different color than the cosmetic article.

For example, the heat-generating applicator part 300 may represent a yellow or gold color.

In this case, the user may easily identify the cosmetic article absorbed by the heat-generating applicator part 300.

In addition, the heat-generating applicator part 300 and the brush part 400 may be formed to represent different colors from each other.

Based on a cross-section of the application part 30 cut along the first direction (see FIG. 4), the metal brushes 330 formed in the second heat-generating applicator 320 may be located on one side (e.g., a lower side) relative to a first imaginary straight line B-B', and the metal brushes 330 formed in the first heat-generating applicator 310 may be located on the other side (e.g., an upper side) relative to the first imaginary straight line B-B'.

In other words, based on a cross-section of the heat-generating applicator part 300 cut along the first direction, the metal brushes 330 formed on the second heat-generating applicator 320 and the metal brushes 330 formed on the first heat-generating applicator 310 may be disposed opposite to each other based on the first imaginary straight line B-B'.

Here, the first direction may be understood as a direction perpendicular to a direction in which the heat-generating applicator part 300 extends.

For example, the surface "E" in FIG. 2 is a surface on which the heat-generating applicator part 300 is cut along the first direction.

Further, based on a cross-section of the application part 30 or the heat-generating applicator part 300 cut along the first direction, the metal brushes 330 formed on the second heat-generating applicator 320 may be distributed to have a first angle θ1 relative to the first imaginary straight line B-B' (see FIG. 4). Here, the first angle θ1 is 180 degrees.

Furthermore, based on a cross-section of the application part 30 or the heat-generating applicator part 300 cut along the first direction, the metal brushes 330 disposed on one side (a right side based on FIG. 4) and formed on the first heat-generating applicator 310 may be distributed to have a second angle θ2 based on the first imaginary straight line B-B' (see FIG. 4). Here, the second angle θ2 is 1 to 60 degrees.

The second angle θ2 may be understood as the angle formed by the first imaginary straight line B-B' and a second imaginary straight line O-C.

Here, the second imaginary straight line O-C may be understood as an imaginary line connecting the center O of the heat-generating applicator part 300 and the end of the metal brushes 330 which are disposed on the one side (the right side with reference to FIG. 4) and are formed on the first heat-generating applicator 310.

Furthermore, based on a cross-section in which the application part 30 or the heat-generating applicator part 300 is cut along a first direction, the metal brushes 330 disposed on the other side (a left side with reference to FIG. 4) and formed on the first heat-generating applicator 310 may be distributed to have a third angle θ3 based on the first imaginary straight line B-B' (see FIG. 4). Here, the third angle θ3 is 1 to 60 degrees, i.e., the second angle θ2 and the third angle θ3 may be formed to be the same.

The third angle θ3 may be understood as the angle formed by the first imaginary straight line B-B' and the third imaginary straight line O-D.

Here, the third imaginary straight line O-D may be understood as an imaginary line connecting the center O of the heat-generating applicator part 300 and the end of the metal brushes 330 disposed on the other side (e.g., a left side based on FIG. 4) and formed on the first heat-generating applicator 310.

The first angle θ1 described above is 180 degrees, and the second angle θ2 and the third angle θ3 may have a range of 1 to 60 degrees (preferably 10 to 45 degrees).

Here, based on a cross-section in which the application part 30 or the heat-generating applicator part 300 is cut along the first direction, the first imaginary line B-B' may be understood as an arbitrary straight line that is tangent to the center O of the heat-generating applicator part 300 and that divides the first heat-generating applicator 310 and the second heat-generating applicator 320.

That is, the first imaginary straight line B-B' may be understood as a line parallel to the x-axis based on FIG. 4.

The first heat-generating applicator 310 may be formed in a symmetrical shape based on a cross-section of the application part 30 cut along the first direction.

Based on a cross-section of the application part 30 cut along the first direction, the first space S1 in which the brush part 400 is disposed may be provided as a concave groove formed in the heat-generating applicator part 300.

Furthermore, based on a cross-section in which the application part 30 is cut along the second direction (see FIG. 5), the metal brushes 330 may be formed on one side (e.g., the lower side) and the first space S1 in which the brush part 400 is disposed may be formed on the other side (e.g., the upper side).

That is, when the brush part 400 is mounted in the first space S1 of the heat-generating applicator part 300, the metal brushes 330 may be formed on one side (e.g., the lower side) and the non-metal brushes 430 may be formed on the other side (e.g., the upper side) based on a cross-section cut along the second direction of the application part 30.

Here, the second direction is a direction in which the heat-generating applicator part 300 extends, and may be understood as a direction in which the heat-generating applicator part 300 is bisected.

The first direction and the second direction described above are orthogonal to each other.

As described above, the cross-section cut along the first direction may be understood as a cross-section cut based on the surface "E" relative to the heat-generating applicator part 300 in FIG. 3, and the cross-section cut along the second direction may be understood as a cross-section cut based on the "F" surface relative to the heat-generating applicator part 300 in FIG. 3.

The metal brushes 330 formed on the first heat-generating applicator 310 may surround at least a portion of the brush part 400.

Specifically, the first space S1 of the heat-generating applicator part 300 may be formed to be concave, and at least a portion of the non-metal brushes 430 may be disposed in the first space S1 that is formed to be concave.

In addition, at least a portion of the metal brushes 330 and at least a portion of the non-metal brushes 430 may be in contact with each other.

Specifically, end portions 339 of the metal brushes 330 and end portions 439, which are at least portions of the non-metal brushes 430, formed in the first heat-generating applicator 310 may be in contact.

In addition, when no external force from the user is applied, the metal brushes 330 and the non-metal brushes 430 may be in a non-contact state, and when an external force from the user is applied, the metal brushes 330 and the non-metal brushes 430 may be in a contact state.

Based on a cross-section of the application part 30 or the heat-generating applicator part 300 cut along the first direction, the metal brushes 330 separated by the first distance from the center O of the application part 30 may represent a specific temperature, and the non-metal brushes 430 separated by the first distance from the center O of the application part 30 may represent a temperature lower than the specific temperature.

For example, the temperature of the non-metal brushes 430 separated by a first distance from the center O of the application part 30 may be 30° C. to 65° C. lower than the temperature of the metal brushes 330.

Here, the first distance may be provided equal to the diameter of the first heat-generating applicator 310 or the second heat-generating applicator 320.

A first connecting member 350, to which the brush part 400 is coupled, may be formed within the heat-generating applicator part 300.

The first connecting member 350 may be formed as a groove into which a second connecting member 410 of the brush part 400 may be inserted.

The first connecting member 350 may be connected to the first space S1 and may be formed in the direction in which the heat-generating applicator part 300 extends.

The heat-generating element 60 may be disposed within the heat-generating applicator part 300.

The heat-generating element 60 may be embedded in the heat-generating applicator part 300 and may be formed across the entirety of the heat-generating applicator part 300 along the direction in which the heat-generating applicator part 300 extends.

The heat-generating element 60 may be formed over at least 80% of the length of the heat-generating applicator part 300, along the direction in which the heat-generating applicator part 300 extends (see FIG. 5).

The heat-generating element 60 may include a thermistor for safe temperature control.

Further, the metal brushes 330 may be formed in a direction perpendicular to the direction in which the heat-generating applicator part 300 extends, i.e., the metal brushes 330 may extend in the first direction.

The non-metal brushes 430 may also be formed in a direction perpendicular to the direction in which the brush part 400 extends, that is, the non-metal brushes 430 may also extend in the first direction.

The brush part 400 may be provided to be detachable from the heat-generating applicator part 300.

The brush part 400 may include the non-metal brushes 430, which are provided with a material having a lower thermal conductivity than the metal brushes 330.

The brush part 400 may be detachable from the heat-generating applicator part 300 and may be provided in a variety of shapes.

For example, the brush part 400 may be formed by injection molding.

The brush part 400 according to one embodiment may include the second connecting member 410 that is coupled with the first connecting member 350 of the heat-generating applicator part 300; and the non-metal brushes 430 formed of a material (e.g., nylon or rubber material) that may be deformed by an external force.

There may be a plurality of non-metal brushes 430, and the plurality of non-metal brushes 430 may be formed in parallel to each other.

Non-metal brush grooves 420 may be formed between the plurality of non-metal brushes 430.

In this embodiment, by way of example, it is described that the second connecting member 410 is formed as a protrusion and the first connecting member 350 is formed as a groove.

The second connecting member 410 may be provided to be elastically deformable to fit into the first connecting member 350.

The non-metal brushes 430 of the brush part 400 may be formed of a non-metal, and the second connecting member 410 may be formed of an elastically deformable metal.

The use of the stick-like product 1 having a heating function will be described as follows.

The user grips the handle part 10, separates the brush rod 20 from the container 50, and then presses the button 110. In this case, the heat-generating element 60 heats up and transfers heat to the metal brushes 330, and the metal brushes 330 may have a specific temperature.

Thereafter, the user may curl the eyelashes by contacting the eyelashes with the metal brush 330, which is heated to the specific temperature. At this time, the metal brushes 330 and the non-metal brushes 430 may be coated with the cosmetic article, so that eyelash makeup may be performed simultaneously.

In one use case, the user may simultaneously bring the end portions 339 of the metal brushes 330 and the end portions 439 of the non-metal brushes 430 into contact with the eyelashes. This allows the user to more easily apply the cosmetic article to the eyelashes while curling the eyelashes by heating them.

FIG. 7 is a view schematically illustrating a brush part 400' according to another embodiment of the present disclosure.

FIG. 8 is a view schematically illustrating a cross-section in which the brush part 400' of FIG. 7 is cut along in the first direction.

FIG. 9 is a view schematically illustrating a cross-section of the application part 30 in which the brush part 400' and the heat-generating applicator part 300 of FIG. 5 are combined, cut along the first direction.

The embodiments shown in FIGS. 7 to 9 have major differences with respect to the brush part compared to the embodiments shown in FIGS. 1 to 6, and therefore the following description will focus on the differences and refer to the description of the stick-type product 1 having the heating function described in FIGS. 1 to 6 for the same components.

Referring now to FIGS. 7 through 9, the brush part 400' according to another embodiment of the present disclosure may include a first connecting member 410' extending in one direction; and a plurality of non-metal brushes 430' fitted into the first connecting member 410' and extending in a different direction from the first connecting member 410'.

The non-metal brushes 430' may be formed of a deformable material (e.g., a nylon or rubberized material).

Based on a cross-sectional of the application part 30 cut along the first direction (see FIGS. 8 and 9), the non-metal brushes 430' may be disposed only on one side (e.g., an upper side) relative to a fourth imaginary straight line E-E' parallel to the first imaginary straight line B-B'.

That is, based on a cross-section of the application part 30 cut along the first direction, the non-metal brushes 430' may be distributed to have an angle of 90 to 180 degrees, preferably 120 to 150 degrees, relative to the fourth imaginary straight line E-E'.

When the heat-generating applicator part 300 and the brush part 400' are combined, the non-metal brushes 430' may be disposed on one side of the fourth imaginary straight line E-E' and the metal brushes 330 may be disposed on the other side of the fourth imaginary straight line E-E'.

Here, based on a cross-section of the application part 30 cut along the first direction, the fourth imaginary straight line E-E' may be understood as an imaginary line parallel to the first imaginary straight line B-B' and passing through the first connecting member 410' when the heat-generating applicator part 300 and the brush part 400' are combined.

In addition, the non-metal brushes 430' may be arranged along the direction in which the first connecting member 410' extends.

Additionally, each of the non-metal brushes 430' may be formed of slender nylon bristles.

FIG. 10 is a diagram schematically illustrating a brush part 400" according to further another embodiment of the present disclosure.

The brush part 400" shown in FIG. 10 has major differences in the arrangement of a non-metal brushes 430" compared to the brush part 400' shown in FIG. 7, and therefore the following description will focus on the differences and refer to the description of the brush part 400' shown in FIG. 7 for the same components.

Referring to FIG. 10, the brush part 400" according to further another embodiment of the present disclosure may include a first connecting member 410"; and a plurality of non-metal brushes 430" coupled to the first connecting member 410".

Based on the direction in which the first connecting member 410" extends, the length of the non-metal brushes 430" disposed at the central portion of the first connecting member 410" may be formed to be longer than the length of the non-metal brushes 430" disposed at the outer portion relative to the central portion of the first connecting member 410".

Based on a cross-section cut through the brush part 400" in the first direction, the non-metal brushes 430" may be disposed along the entire circumference of the first connecting member 410".

In other words, the non-metal brushes 430" shown in this embodiment may be arranged on both sides of the fourth imaginary straight line E-E'.

When the first connecting member 410" of the brush part 400" of this embodiment is inserted into the first connecting member 350 of the heat-generating applicator part 300 so that the brush part 400" and the heat-generating applicator part 300" are coupled, the non-metal brushes 430" may be pressed by the end portions 339 of the metal brush 330 to be gathered in one direction.

In an example, the non-metal brushes 430" of the brush part 400" may be densely arranged at the end portions 339" of the metal brushes 330" by being gathered at the end portions 339" of the metal brushes 330".

FIG. 11 is a view schematically illustrating a brush part 400''' according to yet another embodiment of the present disclosure.

The brush part 400''' shown in FIG. 11 has a major difference in the length of a non-metal brushes 430''' compared to the brush part 400' shown in FIG. 7, and therefore the following description will focus on the differences and refer to the description of the brush part 400' shown in FIG. 7 for the same components.

Referring to FIG. 11, based on the direction in which the first connecting member 410''' extends, the length of the non-metal brushes 430''' disposed at the central portion of the first connecting member 410''' may be formed to be longer than the length of the non-metal brushes 430''' disposed at the outer portion relative to the central portion of the first connecting member 410'''.

As described above, the heat-generating applicator part 300 of this embodiment may have various shapes of brush parts 400 inserted therein.

In the following, the composition of the cosmetic article stored in the container 50 will be described. The cosmetic article stored in the container 50 may be understood as a stable composition that does not denature even when heated to a certain temperature.

The cosmetic article stored in the container 50 may include a mascara composition.

The mascara composition stored in the container 50 comprises, based on the total weight of the composition, 1 to 30% by weight of microcrystalline wax and 10 to 50% by weight of volatile solvent, wherein the microcrystalline wax includes microstearin wax and paraffin wax, and wherein the composition may show that the change between its viscosity and viscosity (cps) after at least 15 repetitions of heating in a range of 80 to 90° C. and cooling in a range of 20 to 30° C. is 30% or less as measured by a Brookfield viscometer.

The mascara composition of this embodiment may be a continuity anhydride in the form of an emulsion or dispersion, or an emulsion containing an aqueous phase. The continuity anhydride is an oil-in-water dispersion formulation, which is a dispersing formulation without water, and becomes an emulsion when it contains an aqueous phase. The emulsion may be O/W or W/O. In one aspect, the mascara composition of the present embodiment is a continuity anhydride, wherein the oil dispersion formulation is the main formulation.

The mascara compositions of this embodiment may include a fatty phase comprising waxes, oils, thickeners, or mixtures thereof.

Here, the wax may be mainly composed of a straight-chain saturated hydrocarbon, such as a low or medium density polyethylene wax such as PERFORMALENE PLC), a paraffin wax, a microcrystalline wax, or the like, and may be a wax that is solid at room temperature. The above mentioned waxes are insensitive to temperature changes and can act as plasticizers when blended with other crystalline waxes, i.e., the waxes of this embodiment are amorphous and have excellent plasticity, which means that when blended with conventional crystalline waxes, the crystals can be refined to ensure that the crystalline structure is not enlarged and is stable even after repeated heating and cooling.

While conventional mascara composition includes a large amount of crystalline wax, the mascara composition of this embodiment does not include crystalline wax, or includes a wax that is mainly composed of the above mentioned straight-chain saturated hydrocarbon in combination with crystalline wax. In one aspect, the mascara composition may comprise less than or equal to 10% by weight of crystalline wax based on the total content of the composition, and the amorphous wax has also the function of refining the crystalline wax.

The crystalline wax has a melting point because conventional mascara compositions contain a large amount of crystalline wax. Therefore, when heated to a temperature above the final melting point, it is common for the composition to become amorphous in a very short period of time and return to a crystalline state upon cooling. In other words, repeated heating and cooling changes the properties of the composition.

In conventional mascara composition, the crystallization of the wax in the composition with a melting peak is accelerated upon heating and the area of the melting peak increases upon repeated heating and cooling.

In contrast, the mascara compositions of this embodiment do not have a specific melting point and do not have a melting peak. Therefore, the oil-in-water dispersion compositions having no melting point allow the solvent to be rapidly volatilized upon heating to set/curl the eyelashes and maintain the stability of the composition even upon repeated heating and cooling.

The wax content may range from 1 to 50% by weight based on the total weight of the entire composition. This is because waxes have a negligible effect on the formulation when less than 1% by weight is used, and the formulation becomes stiff when more than 50% by weight is used. In one aspect, the wax content may be 10 to 30% by weight based on the total weight of the entire composition.

Said oil may comprise one or more selected from the group consisting of volatile or non-volatile hydrocarbons, silicone oils, and combinations thereof. By way of specific example, the oils include dimethyl silicone oil, methyl phenyl silicone oil, methyl hydrogen silicone oil, methylhydroxy silicone oil, fluorosilicone oil, polyoxyether copolymer, alkyl modified silicone oil, high fatty acid modified silicone oil, amino modified silicone oil, epoxy modified silicone oil, heavy isoparaffin, squalane, liquid paraffin, and the like.

Said oil may comprise from 5 to 30% by weight in one aspect and from 7 to 25% by weight in another aspect, based on the total weight of the composition. This is because below the range of 5% by weight or less, the effect on the formulation is minimal, and above the range of 30% by weight or more, it is difficult to form the formulation.

Said thickener may be selected from the group consisting of lipophilic, organic, inorganic and mixtures thereof. Said thickener is added to increase the viscosity of the composition and may include, for example, but is not limited to, a plant-based polymer, such as aramid gum, tragant gum, galactan, carob gum, guar gum, carrageenan, pectin, agar, starch, etc. (e. g., corn, wheat, sweet potato, rice); a polymer of microbial origin, such as dextran, fluran, etc.; starch-based polymers such as dextrin myristate, carboxymethyl starch, methylhydroxypropyl starch, etc.; animal-based polymers such as collagen, casein, gelatin, etc.; cellulose-based polymers such as methylcellulose, nitrocellulose, ethylcellulose, hydroxyethylcellulose, cellulose sodium sulfate, hydroxypropylcellulose, carboxymethylcellulose, crystalline cellulose, etc.; Alginate-based polymers, such as sodium alginate, propylene glycol esters, etc.; Vinyl-based polymers, such as polyvinyl methyl ether, carboxyvinyl polymers, etc.; POE-based polymers; POE-polyoxypropylene copolymer-based polymers, etc.; acrylic polymers, such as sodium polyacrylate, polyacrylamide, etc.; inorganic-based water-soluble polymers, such as polyethyleneimine, cationic polymers, bentonite, aluminum magnesium silicate, laponite, hectorite, anhydrous silicic acid, etc.

Said thickener may comprise from 0.05 to 15t % by weight in one aspect and from 0.1 to 13% by weight in another aspect, based on the total weight of the entire composition. When the content of the thickener is less than 0.05% by weight, the role of the thickener is insufficient, and when it exceeds 15% by weight, the excessive use of the thickener causes an increase in viscosity and a severe phenomenon of clumping of the eyelashes, making it difficult to achieve a clean makeup effect.

The mascara compositions of this embodiment may further comprise a pigment. The pigment may be an iron oxide, D&C, FD&C colorant, or rake thereof, and may be, by way of specific example, red or yellow iron, black iron oxide, ultramarine, mica titanate, salts of aluminum, barium, or calcium, carbon black, or rake thereof.

The content of said pigment may be from 0.1 to 20% by weight in one aspect, and from 1 to 10% by weight in another aspect, based on the total weight of the entire composition.

The mascara composition of the present disclosure may further include a film-forming polymer, which may be dispersed, emulsified, or emulsion polymerized. The film-forming polymer forms a film upon application to the eyelashes, which allows for a curling effect or setting of the keratin fibers into a desired shape. The film-forming polymer is a film-forming agent that allows the formation of a non-sticky, uniform film and may include vinyl polymers, acrylate copolymers, alkyl acrylate copolymers, acrylics, silicones, siloxanes, silanes, or combinations of two or more of the foregoing polymers, and may include, by way of specific example, hydrogenated polycyclopentadiene, polyvinyl acetate, polyvinyl alcohol, polyvinyl pyrrolidone, polyacrylate, polymethacrylate, and the like.

Said film-forming polymer may be from 1 to 30% by weight in one aspect and from 5 to 20% by weight in another aspect, based on the total weight of the entire composition. When the content of the film-forming polymer is less than 1% by weight, it is difficult to form a film on the eyelashes, which may cause under eye smudging, and the curling effect or setting power is reduced. In addition, if it exceeds 30% by weight, the film coated on the keratin fibers may be too strong and cause tangling of the eyelashes.

In addition to the above ingredients, the mascara compositions of this embodiment may further comprise emulsifiers, defoamers, preservatives, fragrances, UV absorbers, moisturizers, and the like, without detracting from the purpose and effectiveness of the present disclosure.

The mascara composition of this embodiment is a composition in which, upon repeated use of a typical mascara, the change in viscosity of the mascara composition is 30% or less in one aspect and 15% or less in another aspect even after repeated heating in the range of 80 to 90° C. and cooling in the range of 20 to 30° C. Said change in viscosity may be measured using a Brookfield viscometer.

The mascara composition of this example may be anhydrous, comprising a volatile solvent, in particular a silicone, hydrocarbon, or fluorinated solvent, and in an exemplary embodiment, said solvent may be, but is not limited to, isododecane, isoparaffin, and the like. The solvent of the anhydrous phase may promote the curling effect of the eyelashes and increase the holding power, i.e., said solvent may protect the disulfide bonds within the hair to maintain the finished curl for an extended period of time.

An oil-dispersion formulation of the mascara of this example may be prepared by heating the wax to dissolve it in a solvent, dispersing it in a pigment, introducing other compositions such as a film-forming polymer and the like, and cooling. An emulsion formulation may also be prepared by dissolving the wax in a solvent and dispersing it in the pigment, preparing the oil phase part separately from the water phase part to be heated and introduced, adding other compositions thereto, and cooling.

Hereinafter, the configuration and the effects of the present disclosure will be described in more detail by way of examples and experimental examples. However, these examples and experimental examples are provided for illustrative purposes only to facilitate an understanding of the present disclosure and are not intended to limit the category and scope of the present disclosure.

Example 1

A mascara composition in an oil-dispersion formulation was prepared according to a conventional method for preparing a mascara composition, and the following compositions were used:

- Wax (10% by weight of microstalin wax+2% by weight of beeswax+2% by weight of paraffin wax)
- Oil (5% by weight of dimethyl silicone oil)
- Thickener (2% by weight of bentonite+3% by weight of dextrin myristate)
- Film-forming polymer (10% by weight of DC MQ 1640 resin (available from DOW CORNING®)+10% by weight of GRANACRYSIL® BMAS (40% solution of a copolymer of isobutylmethacrylate and silicone-grafted acrylate in isoparaffin, available from Grant Industries))

Solvent (isododecane isoparaffin to 100)

Pigment (appropriate amount)

Experimental Example 1

The mascara composition of Example 1 was tested for stability to temperature changes was tested. The mascara composition was placed at 90° C. for 1 hour and then at 30° C. for 2 hours, and the viscosity of the composition was measured. The test is based on the reality of the use of a conventional mascara composition. If a conventional mascara, which is typically in use for 3 months, is used 90 times for 4 minutes each time, it will be in use for a total of 6 hours. The reality of the use was altered in an accelerated test where the mascara was heated up and cooled down 15 times (cycles), which is more severe than the normal conditions of use. This is the same conditions under which the mascara composition was heated for approximately 15 hours. If the viscosity deviation of the mascara composition between the first cycle and the last cycle is less than 25%, the mascara composition is considered stable to repeated heating and cooling, and it is concluded that the properties of the composition have not changed.

For comparison, a typical mascara composition (Rich Curling Mascara, which is available from HERA CO., LTD., and is manufactured by AMOREPACIFIC CORPORATION) was also repeatedly heated and cooled in the same way as described above. The viscosity of the mascara composition of Example 1 and the typical mascara composition was measured prior to the first experiment (0 times), and the viscosity was measured after heating and cooling cycles up to 15 times in units of 2.

Viscosity measurements were performed using a Brookfield HADV-III U viscometer with an LV spindle operating under a 50/60 Hz power supply.

For the typical mascara, the viscosity of the composition had already increased significantly after 3 cycles, making it difficult to measure the viscosity in the same way as at the beginning, while the mascara composition of Example 1 showed a viscosity deviation of less than 25% even after 15 cycles.

Experimental Example 2

An aluminum sampler was filled with 10 mg each of a typical mascara composition and the mascara composition of Example 1, heated from 20° C. to 90° C. at a rate of 5° C./min, and then cooled from 90° C. to 20° C., and the cycle was repeated 15 times. The change in temperature of the compositions over time was measured using a DSC Q1000 instrument from TA Instruments Inc.

For the mascara composition of Example 1, the melting point and melting peak were not visually identifiable.

While the stick-type product 1 having a heating function according to an example of the present disclosure has been described so far as specific embodiments, these are only exemplary embodiments, and the present disclosure should be construed in the broadest scope based on the basic technical ideas disclosed herein, rather than as being limited to them. By combining or substituting a part or parts of the embodiments disclosed herein, the ordinary skilled in the art may carry out an embodiment which is not explicitly described herein, but it should be noted that it shall not depart from the scope of the patent right of this disclosure. Further, the ordinary skilled in the art may readily change or modify the embodiments disclosed herein based on this disclosure, and however, it is understood that such changes or modifications will also fall within the scope of the patent right of this disclosure.

NUMERICAL REFERENCES OF DRAWINGS

1: stick-type product having a heating function
10: handle part
20: brush rod
30: application part
300: heat-generating applicator part
310: first heat-generating applicator
320: second heat-generating applicator
330: metal brushes
400: brush part
430: non-metal brushes
50: container
60: heat-generating element

What is claimed is:

1. A stick-type product having a heating function comprising:
- a handle part that is graspable by a user;
- a brush rod extending from the handle part; and
- an application part provided at one end of the brush rod and configured to apply a cosmetic article,
- wherein the application part comprises:
  - a heat-generating applicator part having a plurality of metal brushes formed along an outer circumference thereof; and
  - a brush part including non-metal brushes detachable from the heat-generating applicator part and formed of a material having a lower thermal conductivity than the metal brushes.

2. The stick-type product having a heating function of claim 1, wherein the metal brushes are formed of metal; and
- the non-metal brushes are formed of nylon having a lower thermal conductivity than the metal.

3. The stick-type product having a heating function of claim 1, wherein each of the metal brushes includes:
- a flat surface parallel to a direction in which the heat-generating applicator part extends;
- a first inclined surface extending from one side of the flat surface and inclined in one direction relative to the direction in which the heat-generating applicator part extends; and
- a second surface extending from the other side of the flat surface and inclined in the other direction relative to the direction in which the heat-generating applicator part extends.

4. The stick-type product having a heating function of claim 1, wherein a metal brush groove is formed between the plurality of metal brushes, which is a space in which the cosmetic article is collected.

5. The stick-type product having a heating function of claim 1, wherein a heat-generating element capable of heating to a predetermined temperature is provided within the heat-generating applicator part.

6. The stick-type product having a heating function of claim 1, wherein the heat-generating applicator part includes:
- a first heat-generating applicator having a first space formed therein capable of accommodating the brush part; and a second heat-generating applicator integrally formed with the first heat-generating applicator and having a second space in which a heat-generating element capable of being heated to a predetermined temperature is inserted, and wherein the metal brushes are formed along an outer circumference of the first heat-generating applicator and the second heat-generating applicator.

7. The stick-type product having a heating function of claim 6, wherein based on a cross-section of the application part cut along a first direction, the metal brushes formed on the first heat-generating applicator and the metal brushes formed on the second heat-generating applicator are located opposite to each other based on a first imaginary straight line B-B'.

8. The stick-type product having a heating function of claim 6, wherein based on a cross-section of the application part cut along a first direction, the first space in which the brush part is disposed is provided as a concave groove formed on the heat-generating applicator part.

9. The stick-type product having a heating function of claim 6, wherein based on a cross-section of the application part cut along a first direction, the metal brushes formed on the second heat-generating applicator are distributed to have a first angle based on a first imaginary straight line B-B', the metal brushes disposed on one side and formed on the first heat-generating applicator are distributed to have a second angle based on the first imaginary straight line B-B', and the metal brushes disposed on the other side and formed on the first heat-generating applicator are distributed to have a third angle based on the first imaginary straight line B-B', and wherein the first angle is 180 degrees, and the second angle and the third angle are each between 1 degree and 60 degrees.

10. The stick-type product having a heating function of claim 1, wherein end portions of the metal brushes and at least portions of the non-metal brushes are in contact with each other.

11. The stick-type product having a heating function of claim 1, wherein the metal brushes are formed of a metal that is not deformed by an external force less than or equal to a certain magnitude applied by a user; and the non-metal brushes are formed of a material that is deformed by the external force.

12. The stick-type product having a heating function of claim 1, further comprising:

a container configured to store the cosmetic article and accommodate the brush rod and the application part.

13. The stick-type product having a heating function of claim 1, wherein the metal brushes represent a temperature from 45° C. to 65° C. during operation of the stick-type product having a heating function.

14. The stick-type product having a heating function of claim 1, wherein based on a cross-section of the application part cut along a first direction, the metal brushes separated by a first distance from a center of the application part represent a specific temperature; and the non-metal brushes separated by the first distance from the center represent a temperature lower than the specific temperature.

15. The stick-type product having a heating function of claim 1, wherein the brush part includes:

a first-connecting member coupled to the heat-generating applicator part; and a plurality of non-metal brushes coupled in a different direction relative to the direction in which the first connecting member extends, and wherein based on a cross-section of the application part cut along a first direction, the non-metal brushes are disposed only on one side relative to an imaginary straight line passing through the first connecting member.

* * * * *